United States Patent [19]

Petzl et al.

[11] Patent Number: 5,076,400

[45] Date of Patent: Dec. 31, 1991

[54] SELF-JAMMING SAFETY DEVICE FOR A ROPE

[75] Inventors: Paul Petzl, Saint Vincent De Mercuze; Pierre Petzl, Saint Nazaire Les Eymes, both of France

[73] Assignee: Petzl SA, Crolles, France

[21] Appl. No.: 518,507

[22] Filed: May 3, 1990

[30] Foreign Application Priority Data

May 19, 1989 [FR] France ..... 89 06692

[51] Int. Cl.[5] ..... B65H 59/24

[52] U.S. Cl. ..... 188/65.5; 24/134 P

[58] Field of Search ..... 188/65.1, 65.2, 65.4, 188/65.5; 24/132 WL, 134 R, 134 KB, 134 P

[56] References Cited

U.S. PATENT DOCUMENTS

| | | | |
|---|---|---|---|
| 621,475 | 3/1899 | McCormick | 24/134 P X |
| 1,727,687 | 9/1929 | Agobian | 24/134 P |
| 4,596,314 | 6/1986 | Rogelja | 188/65.5 |
| 4,912,817 | 4/1990 | Sanoreid | 24/132 WL X |

FOREIGN PATENT DOCUMENTS

| | | | |
|---|---|---|---|
| 0012126 | 6/1980 | European Pat. Off. | 24/134 R |
| 0132592 | 2/1985 | European Pat. Off. . | |
| 2371375 | 7/1978 | France | 188/65.4 |
| 2451752 | 10/1980 | France . | |
| 2478475 | 9/1981 | France . | |
| 2131921 | 6/1984 | United Kingdom . | |

*Primary Examiner*—Matthew C. Graham
*Assistant Examiner*—Peter M. Poon
*Attorney, Agent, or Firm*—Stevens, Davis, Miller & Mosher

[57] ABSTRACT

A self-jamming safety device for a rope comprises two pulleys, one of which is fixed on a base flange, and the other on a support plate capable of pivoting on an articulation spindle. The pulley is provided with a first braking surface, against which the rope is pressed by a boss of the pulley when the support plate is driven by the tension of the rope to a first jamming position. The pulley is equipped with a second braking surface operating in conjunction with the first surface following continued pivoting movement of the support plate to a second jamming position. Switching between the two jamming positions takes place after the tension of the rope has exceeded a preset threshold.

9 Claims, 3 Drawing Sheets

SELF-JAMMING SAFETY DEVICE FOR A ROPE

BACKGROUND OF THE INVENTION

The invention relates to a self-jamming safety device for a rope, comprising:

a first base flange equipped with a first pulley or fixed stud, which is offset with respect to an articulation spindle extending perpendicular to the first flange, a second pulley securedly united to a support plate mounted with limited pivoting around the spindle in a parallel plane to the base flange, an operating handle associated with the support plate to provide manual releasing of the rope, a second retractable flange arranged to allow the rope to be wound and to pass between the first and second pulleys, a first braking surface arranged on the first pulley, against which the rope is pressed by a boss of the second pulley when the support plate is driven by the tension of the rope to a first jamming position, and a return spring biasing the support plate in the releasing direction to a rest position.

A device of this kind is known from the document FR 2,451,752 corresponding to the STOP descender marketed by the applicant. The reaction of the rope urges the second pulley to a single jamming position, in which the boss jams the rope against the first braking surface. A pivoting travel limiting stop is arranged on the support plate to stop the second pulley in this position. The jamming effect by the boss can however damage the rope when large shocks are incurred following repeated falls.

The object of the invention consists in achieving a safety device which can be used as a descender or a jammer, preventing premature wear of the rope.

SUMMARY OF THE INVENTION

The safety device according to the invention is characterized in that the second pulley is shaped as a cam having a second braking surface designed to operate in conjunction with the first braking surface, following the continued pivoting movement of the support plate to a second jamming position, switching from the first jamming position to the second jamming position taking place when the tension of the rope exceeds a preset threshold.

The second braking surface then takes over from the boss so that the jamming effect of the rope against the first braking surface is greater in the second jamming position than in the first.

The threshold for switching from the first jamming position to the second jamming position depends on the hardness of the return spring of the support plate.

The first and second braking surfaces extend appreciably parallel to one another in the second jamming position of the rope. Jamming of the rope over a large bearing surface prevents it from wearing when large shocks are incurred.

The switching threshold between the two jamming positions can be advantageously adjusted by means of a support plate return spring prestressing adjustment device.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
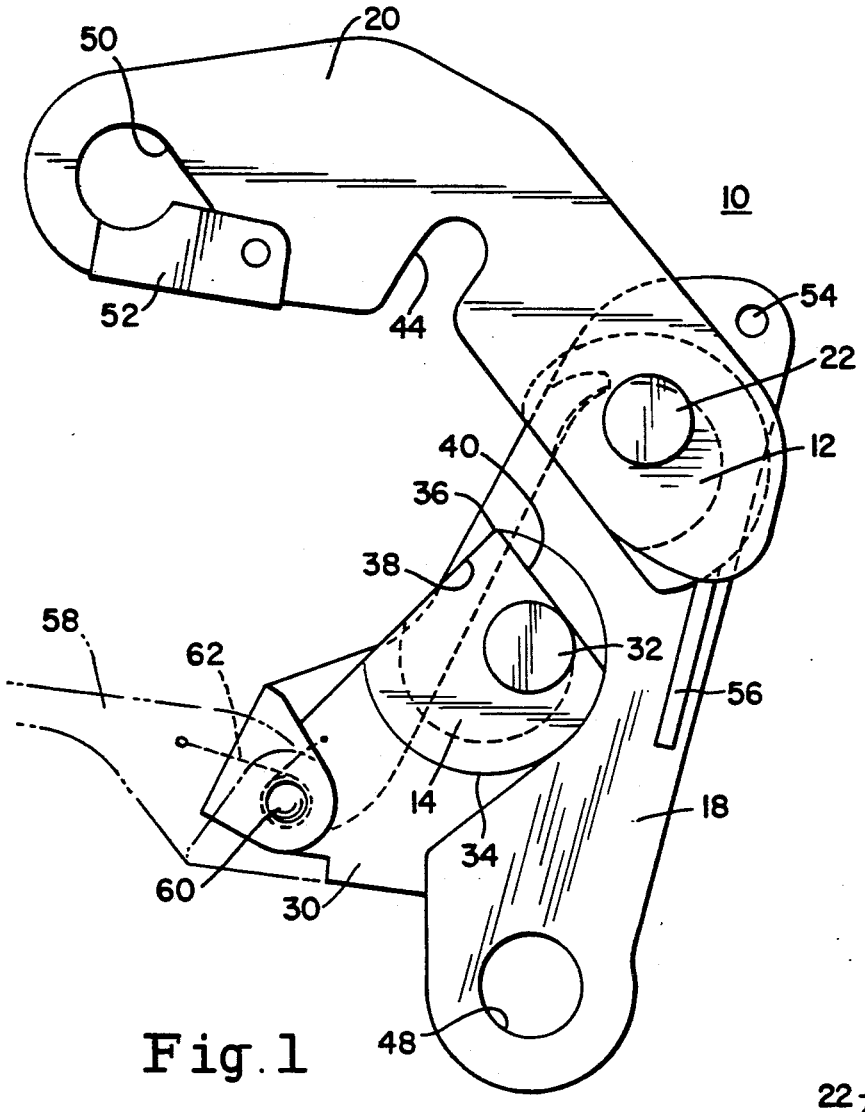
FIG. 1 shows an elevational view of the safety device according to the invention, the second flange being in the separated position, and the operating handle in the rest position (bold lines), and in the working position (broken lines)

In the figures, a safety device 10 for a rope comprises a pair of pulleys 12, 14, housed in a transverse gap 16 arranged between two parallel flanges 18, 20. The first pulley 12 is mounted fixed by means of a fixing part 22 on the first base flange 18, and is immobilized in rotation. The first pulley 12 is equipped with a circular upper section having a guide groove of the rope 26, and with a first braking surface 28, located facing the second pulley 14. The first braking surface 28 is appreciably straight, extending perpendicular to the base flange 18.

The second pulley 14 is securedly united to a movable support plate 30, capable of pivoting around a spindle 32 protruding out from the flange 18. The support plate 30 is separated from the base flange 18 by a small axial clearance, allowing limited pivoting movement of the plate 30 in a movement plane parallel to the flange 18.

Figure 6:
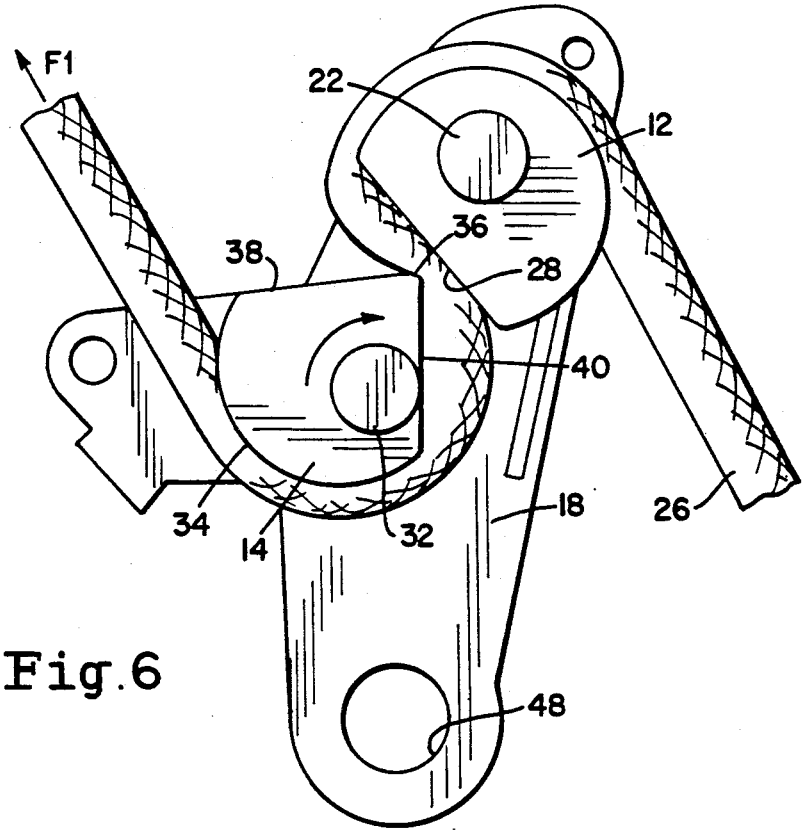
FIGS. 6 and 7 are identical views to FIG. 5, respectively in the first and second jamming positions.

The second pulley 14 is in the shape of a cam, eccentric with respect to the pivoting spindle 32. The pulley 14 comprises a circular lower section having a winding groove 34 of the rope 26, said groove 34 being centered on a fictitious axis, slightly offset with respect to the pivoting spindle 32. Opposite the groove 34 there is located a boss 36 designed to jam the rope 26 against the first braking surface 28, when the support plate 30 is in an intermediate position corresponding to a first jamming position (FIG. 6).

A second braking surface 38 and a third guiding surface 40 of the rope 26 extend between the boss 36 and the circular groove 34 of the second pulley 14. The second surface 38 is appreciably straight, and is located farther from the spindle 32 than the third surface 40.

The positioning of the spindle 32 of the second pulley 14 is such that the boss 36 never comes into engagement against the first braking surface 28 of the pulley 12. In the intermediate position in FIG. 6, the clearance for the rope 26 to pass between the first surface 28 and the boss 36 is very small, so as to provide a first jamming when the value of the tension exerted on the rope 26 is lower than a preset threshold.

The support plate 30 and pulley 14 assembly is capable of continuing the pivoting movement beyond the intermediate position to a final position (FIG. 7), when the tension of the rope 26 exceeds the setting threshold of the device 10. The first and second braking surfaces 28, 38 then extend parallel to one another to constitute the second jamming position, which comes into operation when the user falls.

Figure 5:
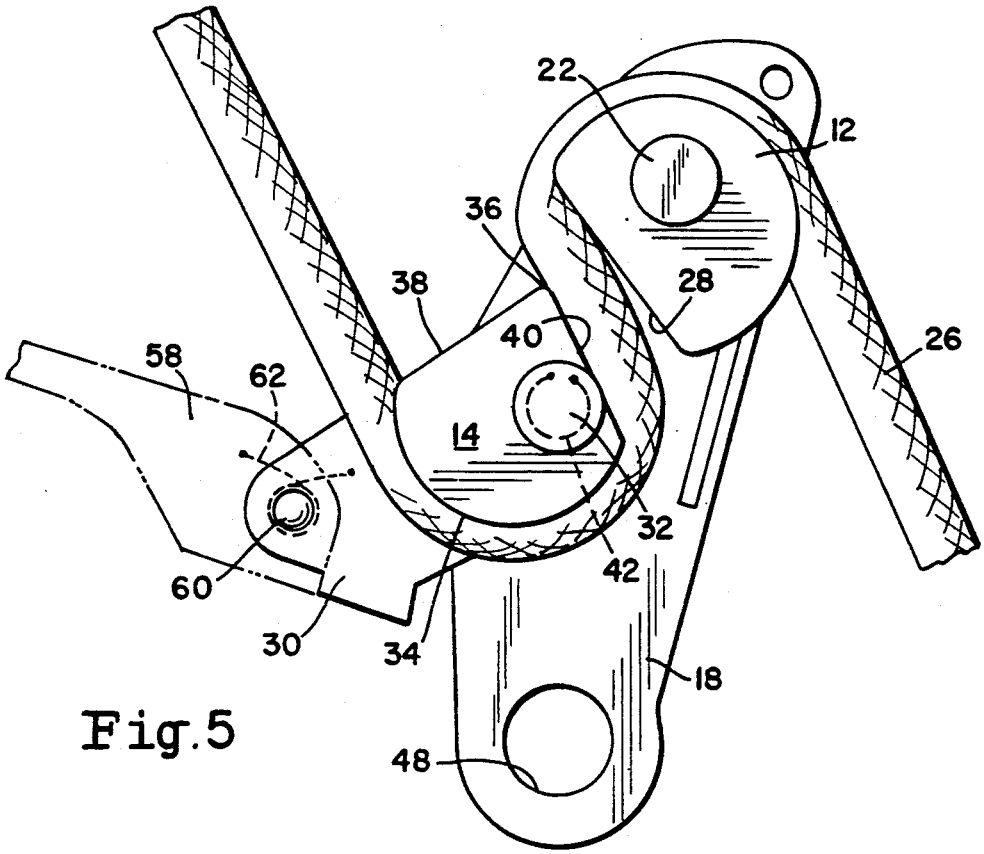
FIG. 5 shows the safety device in the released position in normal use, the second flange not being shown.

The setting threshold between the two jamming positions of the second pulley 14 depends on the return force of a torsion spring 42, shown by a broken line in FIG. 5. The spring 42 is mounted coaxially on the spindle 32, being integrated under the pulley 14 in a circular housing arranged in the support plate 30. One of the ends of the spring 42 is hooked onto the second pulley 14, and the other end to the base flange 18. When there is no tension on the rope 26, the prestressing of the spring 42 causes the support plate 30 and pulley 14 assembly to return to a rest position represented in FIG. 1. This position is suitable for fitting the rope 26, which is wound in an S in the two grooves 24, 34 of the pulleys 12, 14 with an intermediate passage between the two surfaces 28, 40.

The second flange 20 (FIG. 1) serves the purpose of blocking off the transverse gap 16 after the rope 26 has been fitted in place. The upper part of the flange 20 is mounted with limited swiveling on a pivot of the fixing part 22 of the first pulley 12.

The maximum separation position of the second flange 20 (FIG. 1) enables the rope 26 to be wound round the two pulleys 12, 14. In the closed position, represented in FIG. 2, the two flanges 18, 20 are located facing one another, preventing the rope 26 from being released from the gap 16. The middle zone of the second flange 20 comprises a half-open U-shaped slit 44, designed to operate in the closed position in conjunction with a swivel travel limiting stop 46 of the flange 20. The stop 46 is disposed in the extension of the spindle 32 of the second pulley 14.

The lower part of the base flange 18 is fitted with a first opening 48 to which a karabiner (not shown) can be attached. The second flange 20 comprises a second conjugate opening 50 designed to come into alignment in the closed position with the first opening 48, to enable the karabiner to be fitted by means of an articulated ratchet 52.

Opposite the opening 48, the base flange 18 comprises an orifice 54 for an auxiliary cord (not shown) to pass through.

In the middle zone of the base flange 18, the straight edge is equipped with a bracket-shaped rib 56, arranged to prevent the rope 26 from being wound the wrong way on the pulleys 12, 14.

An operating handle 58 is associated with the support plate 30 to pivot the second pulley 14 around the spindle 32 by manual action, from one of the two jamming positions (FIG. 6 or 7) to the released position (FIG. 5). The operating handle 58 is advantageously articulated on the plate 30 at a point 60 situated opposite the rib 56, and cooperates with a return spring 62 which biases the handle 58 to a raised rest position (bold line in FIG. 1). The working position of the handle 58 is illustrated by the broken line in FIGS. 1 and 5, and is obtained by lowering the handle 58 counterclockwise against the return force of the spring 62. Releasing the handle 58 causes it to return automatically to the raised rest position.

The operating handle 58 could be fixed without articulation to the support plate 30.

Figure 2:
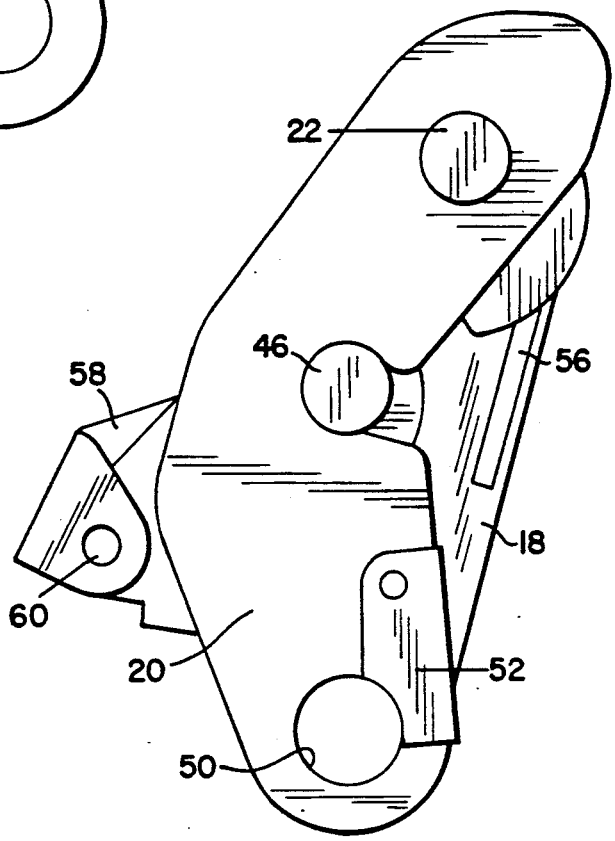
FIG. 2 is an identical view to FIG. 1, in the closed position of the second flange.
Figure 3:
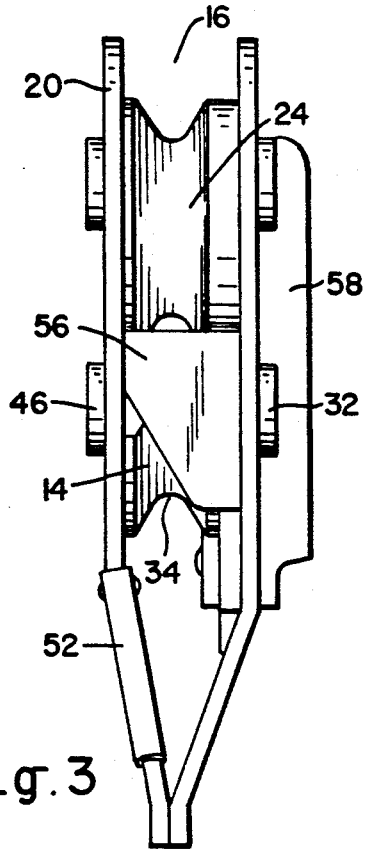
FIG. 3 is a right-hand view of FIG. 2.
Figure 4:
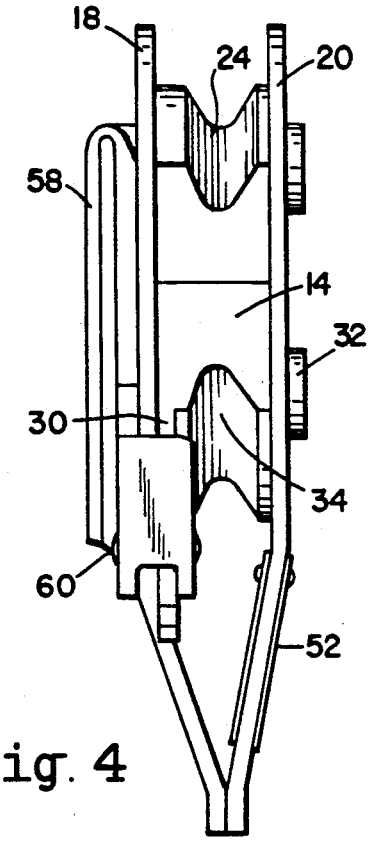
FIG. 4 is a left-hand view of FIG. 2.

Operation of the safety device 10 is described hereafter for descender use:

The user first fits the rope 26 on the pulleys 14, 12, after the second flange 20 has previously been swiveled to the left to the separated position (FIG. 1). The rope 26 is first wound in the groove 34 of the second pulley 14, then passes in the intermediate gap arranged between the first and the third surfaces 28, 40, and is finally wound in the guide groove 24 of the fixed first pulley 12. The rib 56 prevents the rope 26 from being wound incorrectly. Reclosing of the second flange 20 confines the rope 26 in the transverse gap 16 of the device 10. Fitting the karabiner in the two openings 48, 50 keeps the two flanges 18, 20 facing one another, preventing the rope 26 from being released accidentally.

The karabiner is attached to the user's harness by a link strap and the uphill strand of the rope 26 is fixed to an upper fastening point.

In the course of the descent along the rope 26, the user positions the operating handle 58 in the working position, and pivots it to the lowered position corresponding to the released position of the second pulley 14 (see FIG. 5). The gap between the first and third surfaces 28, 40 is sufficient not to jam the rope 26. The speed of descent depends on the friction of the rope 26 in the grooves 34, 24 and can be adjusted by the handle 58.

If the handle 58 is voluntarily released in the course of a normal descent, i.e. without a fall, the tension F1 of the rope 26 (see FIG. 6) causes clockwise pivoting of the support plate 30 and pulley 14 assembly to the intermediate position, in which the boss 36 jams the rope 26 against the first braking surface 28. The device 10 is then in the first jamming position causing the downward movement to be arrested. The tension F1 of the rope 26 is lower than the setting threshold of the device 10. The second pulley 14 remains immobilized in this intermediate position, as long as the operating handle 58 is not actuated.

To restart, the handle 58 merely has to be set to the working position and moved to the lowered position (FIG. 5).

Figure 7:
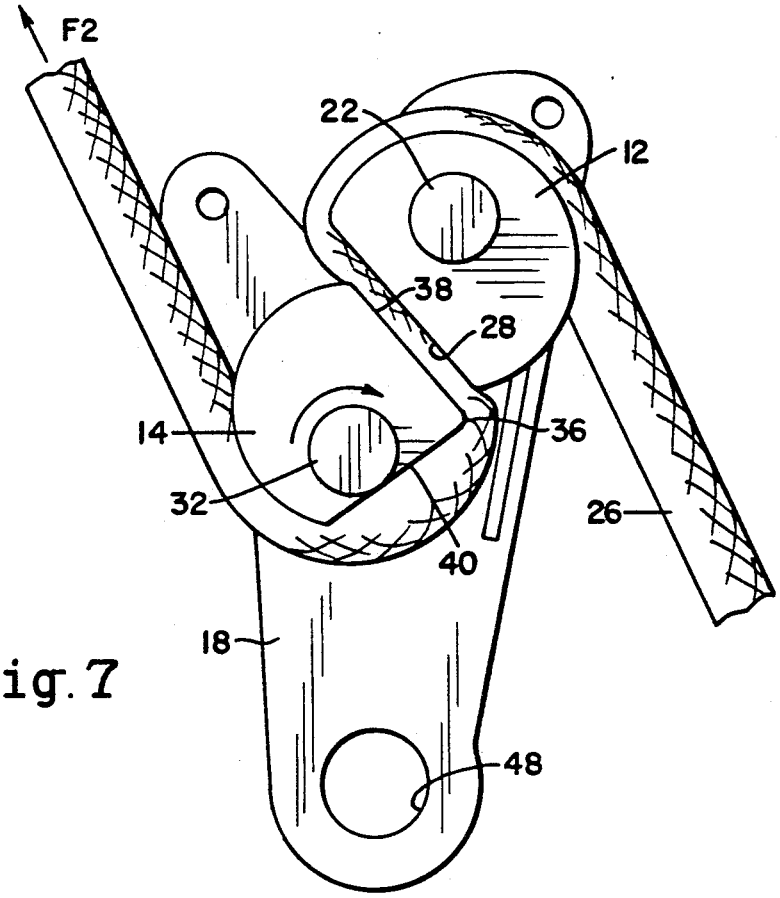

If the handle 58 is accidentally released following a fall, the tension F2 of the rope 26 causes pivoting of the second pulley 14 to the final position, in which the rope 26 is jammed between the first and second braking surfaces 28, 38 (FIG. 7). The device 10 is in the second jamming position, as the tension F2 of the rope 26 is higher than said setting threshold. It can be noted that the degree of jamming of the rope 26 in the device 10 depends on the value of the tension exerted on the support plate 30 and pulley 14 assembly. When the setting threshold of the device 10 is not exceeded (the case of the tension F1), the small bearing surface of the boss 36 is sufficient to define the first jamming position. If the threshold is exceeded by the tension F2 of the rope 26, the second braking surface 38 takes over from the boss 36 to define a larger bearing surface in the second jamming position. The jamming effect is greater in this second jamming position, but the rope 26 is not damaged due to the flat shape of the two surfaces 28, 38.

The safety device 10 is particularly well-suited to mountain-climbing, both as a descender and as a jammer for securing by the second climber or solo.

It can be noted in FIG. 1 that the swiveling direction of the second flange 20 to the separated position takes place to the left. This results in the mechanical resistance of the device 10 being increased in the event of shocks. The positioning of the slit 44 engaged on the stop 46 of the spindle 32 (FIG. 2) prevents any inadvertent opening of the flanges 18, 20 following a shock.

The switching threshold from the first jamming position to the second jamming position can be adjusted according to the weight of the user. Adjustment is achieved by setting the prestressing of the torsion spring 42 in the rest position. One of the ends of the spring 42 can be connected to an adjustment device, notably a rotary knob accessible from the opposite face of the base flange 18. When the setting has been made, the rotary knob is locked. This adjustment enables the threshold to be adjusted accurately in a range comprised between 100 and 500 daN.

The threshold can be further adjusted by varying the relative position of the second pulley 14 with respect to the first pulley 12.

According to an alternative embodiment (not shown), the first pulley 12 is replaced by a simple fixed stud. The rope 26 is no longer wound in an S-shape, but takes the form of a U-shaped half-loop.

We claim:

1. A self-jamming device for a rope, comprising:

a first base flange equipped with a first pulley defining a stud, which is offset with respect to an articulation spindle extending perpendicular to the first flange, a second pulley defining a cam securedly united to a movable support plate mounted with limited pivoting around the spindle in a parallel plane to the base flange, an operating handle associated with the support plate to provide manual releasing of the rope, a second retractable flange arranged to allow the rope to be wound and to pass between the first and second pulleys, a first braking surface arranged on the first pulley, against which the rope is pressed by a boss of the second pulley when the support plate is driven by the tension of the rope to a first jamming position, and a return spring biasing the support plate in the releasing direction to a rest position, said second pulley defining a second breaking surface and cooperating with said first braking surface when said support plate is pivoted to a second jamming position, movement from the first jamming position to the second jamming position taking place when the tension of the rope exceeds a preset threshold whereby the jamming effect of the rope against the first braking surface is greater in the second jamming position than in the first jamming position.

2. The safety device according to claim 1, wherein the second braking surface has a larger bearing surface than that of the boss.

3. The safety device according to claim 1, wherein the threshold for movement from the first jamming position to the second jamming position depends on the hardness of the return spring of the support plate.

4. The safety device according to claim 1 wherein the first and second braking surfaces extend appreciably parallel to one another in the second jamming position of the rope.

5. The safety device according to claim 1 wherein the second pulley is eccentric with respect to the articulation spindle.

6. The safety device according to claim 1 wherein the second flange is swivel-mounted between a closed position and a separated position on a pivot of the fixing part of the first pulley, and comprises a half-open U-shaped slit designed to cooperate in the closed position with a swiveling travel limiting stop, said stop being disposed in the extension of the articulation spindle.

7. The safety device according to claim 1 wherein the release operating handle is articulated on a point of the support plate, said articulation point being located in the vicinity of the guide groove of the second pulley.

8. The safety device according to claim 7, wherein one of the edges of the base flange comprises a bracket-shaped rib located opposite the articulation point of the operating handle, said rib being arranged to prevent the rope from being wound the wrong way on the pulleys.

9. The safety device according to claim 1 wherein the base flange comprises an adjustment device of the prestressing of the support plate return spring to adjust said threshold.

* * * * *